United States Patent [19]

Kato et al.

[11] Patent Number: 4,980,256

[45] Date of Patent: Dec. 25, 1990

[54] POSITIVELY CHARGEABLE ONE COMPONENT MAGNETIC DEVELOPER

[75] Inventors: Seiichi Kato, Tokyo; Naoto Kitamori, Yokohama; Hisayuki Ochi, Tokyo, all of Japan

[73] Assignee: Canon Kabushiki Kaisha, Tokyo, Japan

[21] Appl. No.: 199,297

[22] Filed: May 26, 1988

[30] Foreign Application Priority Data

May 27, 1987 [JP] Japan ..... 62-133158

[51] Int. Cl.[5] ..... G03G 9/14

[52] U.S. Cl. ..... 430/106.6; 430/903

[58] Field of Search ..... 430/110, 903

[56] References Cited

U.S. PATENT DOCUMENTS 4,051,077 9/1977 Fisher ..... 430/110
4,187,329 2/1980 Crooks ..... 430/110
4,626,487 12/1986 Mitsuhashi ..... 430/110 X
4,640,882 2/1987 Mitsuhashi ..... 430/110
4,758,493 7/1988 Young ..... 430/903

*Primary Examiner*—J. David Welsh

*Attorney, Agent, or Firm*—Fitzpatrick, Cella, Harper & Scinto

[57] ABSTRACT

A positively chargeable, one component type magnetic developer, comprises:

100 parts by weight of a positively chargeable magnetic toner having triboelectric charges of +9 μc/g to +20 μc/g and a volume average particle size of 5 to 30 μm, 0.01 to 5 parts by weight of negatively chargeable resin fine particles having triboelectric charges of −10 μc/g to −40 μc/g and a primary average particle size of 0.01 to 4 μm, and 0.05 to 10 parts by weight of positively chargeable silica fine particles having triboelectric charges of +100 to +300 μc/g and a primary average particle size of 5 mμ to 30 mμ.

10 Claims, No Drawings

POSITIVELY CHARGEABLE ONE COMPONENT MAGNETIC DEVELOPER

BACKGROUND OF THE INVENTION

1. Field of the Invention

This invention relates to a developer for developing electrostatic images by image forming methods such as electrophotography, electrostatic recording, and electrostatic printing. More particularly, the present invention pertains to a positively chargeable one component magnetic developer which is charged uniformly positively in the direct or indirect electrophotographic developing method to give an image of high quality by visualizing negative electrostatic images or visualizing positive electrostatic images by reversal development.

2. Related Background Art

In the prior art, there have been known as the electrophotographic methods such those as disclosed in U.S. Pat. No. 2,297,691, Japanese Patent Publication No. 42-23910 (U.S. Pat. No. 3,666,363), and Japanese Patent Publication No. 43-24748 (U.S. Pat. No. 4,071,361). Generally speaking, a photoconductive material is utilized to form electrostatic latent images on a photosensitive member by various means, then said latent images are developed by use of a toner or a developer, and after transferring optionally the toner images on a transfer material such as paper if necessary, the images are fixed by heating, pressure, pressure and heat fixing roller or solvent vapor to obtain a copied product. When transferring the toner image, there is provided generally the step for removing the residual toner on the photosensitive member.

As a development method for visualizing electrostatic latent images by use of a toner, there have been known the magnetic brush method as disclosed in U.S. Pat. No. 2,874,063, the cascade developing method disclosed in U.S. Pat. No. 2,618,552 and the powder cloud method disclosed in U.S. Pat. No. 2,221,776, and the method in which an electroconductive magnetic toner is used as disclosed in U.S. Pat. No. 3,909,258.

As the toner to be applied for these developing methods, fine powder containing a dye, a pigment dispersed in a natural or synthetic resin has been employed. For example, particles having a dispersion of a colorant in a binder resin such as polystyrene which are pulverized finely to about 1 to 30μ have been used as the toner. As the magnetic toner, those having magnetic particles such as magnetite contained therein have been used. In the case of a system employing the two component system developer, the toner is generally employed as a mixture with carrier particles such as glass beads, iron powder, ferrite powder.

As the positively charged controlling agent to be used for the toner for such dry process development, for example, a quaternary ammonium compound, an organic dye (especially basic dye or its salt), Nigrosine base or Nigrosine has been employed. These are generally added in a thermoplastic resin, dispersed by melting under heating, and the mixture is finely pulverized and controlled to suitable particle sizes, if necessary.

However, these charge controlling agents are liable to cause the phenomenon of lowering in charge controllability due to mechanical shock, friction, changes in temperature and humidity conditions.

Accordingly, when development is performed by use of a toner containing these as the charge controlling agent in a copying machine, deterioration of the toner may be sometimes caused to occur during successive copying as the number of copies increases. Since these charge controlling agents are dispersed uniformly in a thermoplastic resin with extreme difficulty, there is the problem that there is readily caused a difference in triboelectric charges between the toner particles obtained by pulverization. For this reason, various methods have been practiced in the prior art for effecting dispersion more uniformly. For example, a basic Nigrosine dye is used in the form of a salt formed with a higher fatty acid in order to improve compatibility with a thermoplastic resin. However, unreacted fatty acid or the dispersed product of salt is frequently exposed on the toner surface to cause contamination of the carrier or the toner carrying member, lowering in flowability of the toner, fogging, or lowering in image density. For the purpose of improving dispersion of these charge controlling agents into the resin, there is also employed the method in which the charge controlling agent powder and the resin powder is mechanically pulverized and mixed before hot melting and kneading. However, the inherent dispersion difficulty cannot be avoided, and it has been desired to have a developer having more uniform positive chargeability.

There has been also an attempt to give uniform charges to the toner by making the binder resin itself positively chargeable by introducing amino groups by way of copolymerization or graft polymerization of a positively chargeable monomer such as dimethylaminoethyl methacrylate into a binder resin. However, the positive chargeability of the binder resin as mentioned above is not necessarily constant, but it is greatly changed depending on the magnitude of frictional force and friction probability between the toner particles, or between toner and carrier, and between toner and toner carrying member such as sleeve, and therefore it is not easy to provide always constant and stable positive charges to the toner. Accordingly, the positive chargeability of the toner when no adequate friction can be obtained is very unstable, whereby the copied image obtained by said toner becomes an image with much fog and scattering. On the contrary, when excessive friction is caused, the positive charges on the toner surface become extremely great, such that only an image with excessive coarseness and low density can be obtained.

Japanese Patent Laid-Open Application No. 59-201063 (U.S. Pat. No. 4,568,625) discloses a technique in which a positively chargeable developer is prepared by use of a silica fine powder treated with a silicone oil having amines in the side chain. Japanese Patent Laid-Open Application No. 61-160760 (U.S. Pat. No. 4,666,813) proposes a technique in which a specific fluorine-containing compound is added in the developer.

The present inventors have found that in a digital copying machine which develops digital latent images with low potential contrast of latent image (e.g. 300 V or less) according to the reversal developing system, the image density tends to be lowered in continuous successive copying test of a large number of sheets with the use of a developer in which a positively chargeable silica is merely mixed within the positively chargeable toner. The tendency is also the same in a developer in which an external agent such as polyvinylidene fluoride fine particles is added in the positively chargeable toner and further, a developer comprising a mere mixture of a positively chargeable toner, silica fine particles and polyvinylidene fluoride fine particles is still unsatisfactory with respect to developing characteristics and durability in the light of the present desire for higher image quality and higher durability.

On the other hand, in a high speed copying machine which effects normal development of negatively charged electrostatic latent images at a process speed of 300 mm/sec or higher, a high performance positively chargeable one component developer has been also awaited.

As a specific example, although only a negatively chargeable developer is disclosed, Japanese Patent Laid-Open Application No. 61-250658 proposes a developer containing fine particles of the same polarity to the charged polarity and fine particles of the opposite polarity thereto. The present inventors prepared a developer by imparting positively chargeable silica and negatively chargeable silica to a positively chargeable toner, and conducted successive copying test by means of the digital or high speed copying machines. Only insufficient developability could be obtained.

A-Si (amorphous silicon) has high photosensitivity over the whole visible region, and therefore can correspond to a copying machine or printer by use of a semiconductor laser or a copying machine for color. A-Si photosensitive drum has a high surface hardness, can be expected to have long life, having a Vickers hardness of 1,500 to 2,000, and also has successive copying performance of 20 to 500,000 sheets which is several-fold of the CdS photosensitive member which is said to have the highest durability and abrasion resistance. Even with respect to heat resistance, it can be sufficiently used within the range of the practical level of an electronic copying machine.

In spite of such advantages, amorphous silicon involves the problems in reduction of cost and productivity. Generally speaking, the surface dark potential of A-Si photosensitive member corresponding to film thickness is said to be 20 to 30 V/$\mu$m. The surface dark potential of the photosensitive member practically applied at present is required to be 500 V at the minimum in CdS system, and 600 to 800 V in the Se system and the organic photoconductive (OPC) member system. For accomplishing this potential in A-Si, at least a film thickness of 30$\mu$ or more is necessary. In view of various fluctuations of characteristics, lowering in sensitivity depending on the difference of environment, A-Si should preferably have a film thickness of 40$\mu$ or more. For obtaining a film thickness of 40$\mu$ or more, there ensue the problems of elevation in production cost and lowering in production capacity of A-Si. Increase of film thickness tends to cause abnormal growth of A-Si film during preparation steps, whereby partially non-uniform A-Si film is formed to give rise to irregularity in the image, making the film practically useless. To cope with such problems, it has been proposed to make the film thickness of A-Si as thin as 5 to 25$\mu$, while satisfying both aspects of productivity and cost, and performances of A-Si photosensitive member. When the A-Si film thickness becomes 5 to 20$\mu$, the surface dark potential which can be used stably becomes 300 to 400 V. In such case, it is extremely difficult to obtain stably sufficient solid black at a low potential with a developing contrast between the light portion and the dark portion of 300 V or less (e.g. 280 to 250 V) with a conventional developer. The developing contrast in normal developing refers to the absolute value of the average dark portion potential of the photosensitive drum from which the developing potential was substrated.

In order that an A-Si photosensitive member which has been made thinner can be practically used under such conditions, a toner having uniform and high charging ability capable of developing at low potential must be used.

Particularly, when the image signals are digital signals, the latent images are formed by gathering of the dots of constant potential, and the solid portion, the half tone portion and the light portion are respectively expressed by changing the density of the dots. Accordingly, every portion is formed of electrostatic latent images of basically the same potential in the case of binary value.

There has been also developed the multi-value recording method, in which information in the depth direction per one dot is given from the binary value method of the prior art as described above.

The method, in forming images by a laser beam printer by forming digital signal values into binary values, in order to obtain gradation characteristics of half tone, comprises converting the digital image signals into analog signals, generating binary value signals applied with pulse width modulation by comparing the analog signals with periodical pattern signals such as triangular waves, and utilizing the binary signals as the driving signals for the laser beam source. Thus, by pulse width modulation of the digital image signals, it becomes possible to obtain both high resolution and high gradation characteristics.

However, when a negatively charged electrostatic latent image on the A-Si drum formed by the digital signals as described above is reversely developed by use of a positively chargeable developer of the prior art, a number of problems occur because of non-uniform charging generated on the toner particle surfaces.

When the developing contrast of the latent image potential is low, and if developing is repeated, toner particles having uniform charging are preferentially consumed for development (the so-called selective development), to give the result that when continuous copying is conducted, the ratio of the toner particles non-uniformly charged will be increased to bring about various problems such as lowering in image density, and lowering in image quality.

Recently, an OPC drum for forming negatively charged latent images has been attempted to be made durable and a positively chargeable toner has been applied for high speed machines. In this case, not only in development of digital latent images as described above, but also in development of analog latent images, it is required to have a positively chargeable developer having high durability which can stand copying of more sheets than in the prior art.

Further, ground fog, reversal fog, and coarseness tend to be worsened in direct proportion to the increase in process speed, and particularly the tendency is marked in reversal fogging. This phenomenon may be estimated to be caused by the fact that the sliding between the toner and the toner carrying member becomes smaller in chance and also shorter with the increase of the process speed, whereby the toner cannot obtain sufficient and uniform charging.

SUMMARY OF THE INVENTION

An object of the present invention is to provide a positively chargeable one component magnetic developer which has stable triboelectric charges between the toner particles, between the toner and a toner carrying member such as sleeve, and also sharp and uniform distribution of triboelectric charges and can control the charging amount suitable for the developing system employed.

Another object of the present invention is to provide a positively chargeable one component magnetic developer, which is a toner effecting faithful development on digital latent images, has great (gradient of the image density relative to the latent image potential), can increase the density difference between the dots and reproduce sharply the brim portions of the dots.

A further object of the present invention is to provide a positively chargeable one component magnetic developer which can maintain the initial characteristics even when the developer is used continuously for a long term.

Still another object of the present invention is to provide a positively chargeable one component magnetic developer which can reproduce stable images without selective phenomenon when the potential contrast of the latent image is low.

Still further object of the present invention is to provide a positively chargeable one component magnetic developer which reproduces stable images without influence from the changes in temperature and humidity.

Still another object of the present invention is to provide a positively chargeable one component magnetic developer having excellent storage stability which can maintain the initial characteristics even after storage for a long term.

Still further object of the present invention is to provide a positively chargeable one component magnetic developer which can retain constantly good cleaning characteristics.

According to the present invention, there is provided a positively chargeable, one component type magnetic developer, comprising;

100 parts by weight of a positively chargeable magnetic toner having triboelectric charges of +9 μc/g to +20 μc/g and a volume average particle size of 5 to 30 μm, 0.01 to 5 parts by weight of negatively chargeable resin fine particles having triboelectric charges of −10 μc/g to −40 μc/g and a primary average particle size of 0.01 to 4 μm, and 0.05 to 10 parts by weight of positively chargeable silica fine particles having triboelectric charges of +100 to +300 μc/g and a primary average particle size of 5 mμ to 30 mμ.

DETAILED DESCRIPTION OF THE PREFERRED EMBODIMENTS

In the present invention, the negatively chargeable resin fine particles are prepared according to the spray dry method, the suspension polymerization method, the emulsion polymerization method, the seed polymerization method, or the mechanical crushing method, for example. The resin fine particles of the present invention can be selected from fluorine-containing vinyl resin fine particles such as polyvinyl fluoride (PVF), polytetrafluoroethylene (PTFE), polyvinylidene fluoride (PVDF), and perfluoroalkoxyfluorine resin (PFA). Among them, polyvinylidene fluoride (PVDF) is preferred with respect to supplying and dispersing positively chargeable silica into positively chargeable toner particles, and as a cleaning aid.

The quantity of the triboelectric charges of the negatively chargeable resin fine particles is measured as described below. Resin fine particles (2 g) left to stand overnight under an environment of 25° C. and 50 to 60% RH and 98 g of carrier iron powder not coated with a resin having principal particle sizes at 200 to 300 mesh (e.g. EFV 200/300 produced by Nippon Teppun Co.) are mixed thoroughly in an aluminum pot having a volume of about 200 cc under the above environment (shaken vertically with hands for about 50 times), and the quantity of the triboelectric charges of the resin fine particles is measured according to the conventional blow-off method by use of an aluminum cell having a 400 mesh screen.

The crystallinity of the negatively chargeable resin fine particles is defined in the present invention as the value derived according to the following measurement method. This is the method in which the crystallinity is determined from the melting heat determined from the melting peak of differential scanning calorimeter (DSC). By use of a sample of about 20 mg, measurement is conducted from 50° to 200° C. at a temperature elevation speed of 10° C./min., and from the ratio of the area of the melting peak at this time to the area of the melting peak of the standard indium, the melting heat ΔH (cal/g) of this sample is calculated. With the melting heat of the complete crystal as $\Delta Hc = 15$ cal/g, a value determined from the crystallinity $= \Delta H/\Delta Hc \times 100$ (%) is used.

The negatively chargeable resin fine particles are required to have triboelectric charges of −10 μc/g to −40 μc/g.

The resin fine particles desirably have a crystallinity of 60% or higher, preferably 70% or higher. If the crystallinity is lower than 60%, the tendency to cause such problems as lowering in image density or fog is increased, when the development contrast of latent images is low or in the case of high speed development.

The above resin fine particles are desirably controlled to a primary average particle size of 0.01 to 4 μm, preferably 0.1 to 3 μm. For controlling the average particle size, operations such as crushing, pulverization, classification, etc. may be also performed. The primary average particle size is measured by taking a photograph of the secondary particle images at 20,000 to 100,000 magnification by a scanning type electron microscope, and determining the average particle size of several 10 to several 100 primary particles from that photograph.

If the primary average particle size of the resin fine particles exceeds 4 μm, fogging is liable to be caused undesirably. On the other hand, if the primary average particle size is less than 0.01 μm, substantially no effect of addition will appear.

The above resin fine particles may be added in an amount of 0.01 to 5.0 parts by weight, preferably 0.05 to 2.0 parts by weight based on 100 parts by weight of the toner particles. If over 5 parts by weight, increase of fog, density irregularity under low temperature and low humidity environment will be caused due to the presence of free matters not attached to the toner particles. With addition of less than 0.01 part by weight, there will appear substantially no effect.

Since the above negatively chargeable resin fine particles impart positively chargeable silica particles uniformly onto the positively chargeable toner particle surface, it becomes possible to generate stable positive charges. Even under the severe developing conditions where developing with low constrast of latent images or high developing speed are continued for a long term, the above resin fine particles function as a buffering material, and therefore deterioration of the developer will occur with difficulty to give stable image quality from the initial stage over a long term.

Triboelectric values of the positively chargeable silica fine particles are measured according to the following method. Silica fine particles (2 g) left to stand overnight under an environment of 25° C. and 50 to 60% RH and 98 g of carrier iron powder not coated with a resin having principal particle sizes at 200 to 300 mesh (e.g. EFV 200/300 produced by Nippon Teppun Co.) are mixed thoroughly in an aluminum pot having a volume of about 200 cc under the above enviroment (shaken vertically with hands for about 50 times), and the amount of the triboelectric charges of the silica fine particles is measured according to the conventional blow-off method by use of an aluminum cell having a 400 mesh screen. The silica fine particles with positive triboelectric charges measured according to this method are defined as the positively chargeable silica fine particles. In the present invention, the silica fine particles with triboelectric charges of +100 μc/g to +300 μc/g are used.

For obtaining such positively chargeable silica fine particles, it is recommended to treat silica fine particles with a coupling agent having an amino group or a silicone oil having an amino group. Examples of such treating agents may include amino silane coupling agents such as:

$H_2NCH_2CH_2CH_2Si(OCH_3)_3$
$H_2NCH_2CH_2CH_2Si(OC_2H_5)_3$

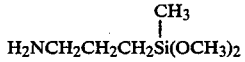

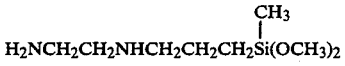

$H_2NCONHCH_2CH_2CH_2Si(OC_2H_5)_3$
$H_2NCH_2CH_2NHCH_2CH_2CH_2Si(OCH_3)_3$
$H_2NCH_2CH_2NHCH_2CH_2NHCH_2CH_2CH_2Si(OCH_3)_3$
$H_3C_2OCOCH_2CH_2NHCH_2CH_2CH_2Si(OCH_3)_3$
$H_5C_2OCOCH_2CH_2NHCH_2CH_2NHCH_2CH_2CH_2CH_2Si(OCH_3)_3$

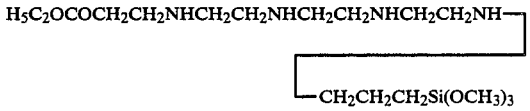

$H_3COCOCH_2CH_2NHCH_2CH_2NHCH_2CH_2CH_2Si(OCH_3)_3$

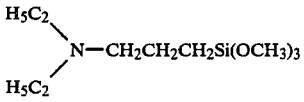

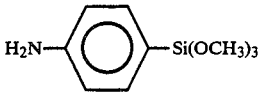

-continued

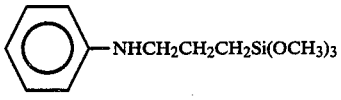

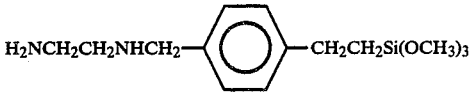

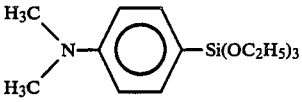

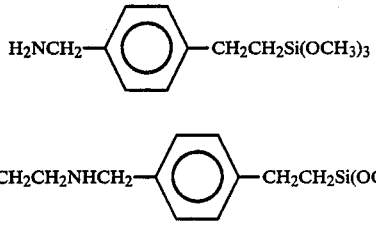

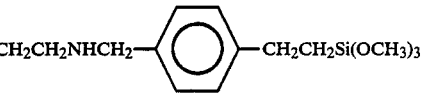

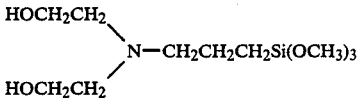

$(H_2CO)_3SiCH_2CH_2CH_2—NHCH_2$
$(H_2CO)_3SiCH_2CH_2CH_2—NHCH_2$

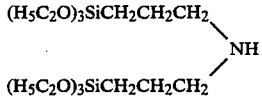

$H_2CNHCH_2CH_2CH_2Si(OC_2H_5)_3$
$H_2N(CH_2CH_2NH)_2CH_2CH_2CH_2Si(OCH_3)_3$
$H_3C—NHCONHC_3H_6Si(OCH_3)_3$

As the silicone oil, there may be generally employed amino-modified silicone oils provided with a partial structure having an amino group in the side chain represented by the following formula:

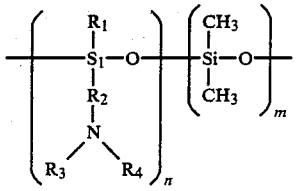

(wherein $R_1$ represents hydrogen, an alkyl, aryl or alkoxy group, $R_2$ represents an alkylene or phenylene group, $R_3$ and $R_4$ each represent hydrogen, an alkyl or aryl group, with proviso that the above alkyl, aryl, alkylene and phenylene groups may have an amine, and also may have a substituent such as halogen, etc. within the range in which the chargeability is not impaired; m and n each represent a positive integer).

Examples of such silicone oils having amino group include the following:

| Trade name | viscosity at 25° C. (cps) | Amine equivalent |
|---|---|---|
| SF8417 (produced by Toray Silicone Co.) | 1200 | 3500 |
| KF393 (produced by Shinetsu Kagaku Co.) | 60 | 360 |
| KF857 (produced by Shinetsu Kagaku Co.) | 70 | 830 |
| KF860 (produced by Shinetsu Kagaku Co.) | 250 | 7600 |
| KF861 (produced by Shinetsu Kagaku Co.) | 3500 | 2000 |
| KF862 (produced by Shinetsu Kagaku Co.) | 750 | 1900 |
| KF864 (produced by Shinetsu Kagaku Co.) | 1700 | 3800 |
| KF865 (produced by Shinetsu Kagaku Co. | 90 | 4400 |
| KF369 (produced by Shinetsu Kagaku Co.) | 20 | 320 |
| KF383 (produced by Shinetsu Kagaku Co.) | 20 | 320 |
| X-22-3680 (produced by Shinetsu Kagaku Co.) | 90 | 8800 |
| X-22-380D (produced by Shinetsu Kagaku Co.) | 2300 | 3800 |
| X-22-3801 (produced by Shinetsu Kagaku Co.) | 3500 | 3800 |
| X-22-3810B (produced by Shinetsu Kagaku Co.) | 1300 | 1700 |

The amine equivalent in the present invention is an equivalent (g/equiv) per one amine, which is a value of the molecular weight divided by the number of amines per one molecule.

Preferable positively chargeable silica particles have a hydrophobicity exhibiting a value in the range of 30 to 80 as measured by the methanol titration test, and they are preferable with respect to environmental resistant characteristic and stability of triboelectric values. For hydrophobic treatment, the conventional hydrophobic method is available, and hydrophobicity can be imparted by treatment with an organic silicon compound which is reactive with or can be physically adsorbed on silica fine particles. A preferable method may be the method in which the silica fine particles are treated with a treating agent such as a nitrogen-containing silane coupling agent as described above and then, or simultaneously with treatment with a treating agent such as a nitrogen-containing silane coupling agent, treated with an organic silicon compound having hydrophobicity.

Examples of such organic silicon compounds having hydrophobicity may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, $\alpha$-chloroethyltrichlorosilane, $\beta$-chloroethyltrichlorosilane, chloromethyldimethylchlorosilane, triorganosilylmercaptan, trimethylsilylmercaptan, triorganosilylacrylate, vinyldimethylacetoxysilane, further, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxanes having 2 to 12 siloxane units per one molecule and hydroxyl group bound to each one Si in the unit located at the terminal end. These can be used individually or as a mixture of two or more kinds.

Here, the methanol titration test is a test for confirming the degree of hydrophobicity of silica fine particles having the surface subjected to hydrophobic modification.

For evaluation of the hydrophobicity of the treated silica fine particles, the "methanol titration test" defined in the present specification is carried out as follows. The silica fine particles to be tested (0.2 g) are added into 50 ml of water in an Erlenmeyer flask of 250 ml volume. Methanol is titrated from a burette until the whole amount of silica is wetted. During this operation, the solution in the flask is constantly stirred by a magnetic stirrer. The end point is observed when the whole amount of the silica fine particles is suspended in the liquid, and the hydrophobicity is represented by the percentage of methanol in the liquid mixture of methanol and water when the end point is reached. The average primary particle size of silica fine particles is measured according to the same method for measurement of the average primary particle size of the negatively chargeable resin fine particles as described above.

The amount of these silica fine particles applied may be 0.5 to 10 parts by weight based on 100 parts by weight of toner to exhibit the effect, and particularly preferably in an amount of 0.1 to 3 parts by weight, whereby a developer exhibiting positive chargeability having excellent stability can be provided. To describe about a preferable embodiment about the mode of addition, it is preferred that 0.01 to 1 part by weight of the treated silica fine powder based on the weight of the developer may be attached onto the surface of the toner particles.

As the binder resin of the toner according to the present invention, there may be employed homopolymers of styrene and derivatives thereof such as polystyrene, polyvinyltoluene; styrenic copolymers such as styrene-propylene copolymer, styrene-vinyltoluene copolymer, styrene-vinylnaphthalene copolymer, styrene-methyl methacrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinylmethyl ether copolymer, styrene-vinylethyl ether copolymer, styrene-vinylmethyl ketone copolymer, styrene-butadiene copolymer, styrene-isoprene copolymer, styrene-maleic acid copolymer, styrene-maleate copolymer, etc.; polymethyl methacrylate, polybutyl methacrylate, polyvinyl acetate, polyethylene, polypropylene, polyurethane, polyamide, polyvinyl butyral, polyamide, polyacrylic acid resin, rosin, modified rosin, terpene resin, phenolic resin, aliphatic or alicyclic hydrocarbon resin, aromatic petroleum resin, paraffin wax, carnauba wax, either singly or as the mixture.

As the colorant material which can be added in the magnetic toner according to the present invention, carbon black, copper phthalocyanine, iron black known in the art can be used.

A positively chargeable controlling agent such as Nigrosine can be used in the toner of the present invention. The positively chargeable magnetic toner to be used in the present invention is required to have triboelectric charges of $+9\ \mu c/g$ to $+20\ \mu c/g$ by use of a positively chargeable controlling agent or a positively chargeable resin.

As the magnetic fine particles to be contained in the toner of the present invention, a material which can be magnetized when placed in a magnetic field can be used, such as powder of ferromagnetic metal such as iron, cobalt, nickel or an alloy or compound such as magnetite, $\gamma$-$Fe_2O_3$, ferrite, etc.

Preferably, magnetic iron oxide particles in which silicon element is present as gradually increased from the surface of the particle toward the central portion of the particle may be used.

The amount of silicon element contained in the magnetic iron oxide may be preferably 0.1 to 1.5% by weight based on iron element with respect to humidity resistance.

The content of magnetic powder may be preferably 10 to 70% by weight based on the toner weight. Preferably, it is 35 to 60% by weight, more preferably 37 to 47% by weight with respect to prevention of fogging during reversal development.

Further, the toner according to the present invention should preferably have a volume resistivity of $10^{10}$ Ω.cm or higher, particularly $10^{12}$ Ω.cm or higher with respect to triboelectric charges and electrostatic transferability. The volume resistivity as mentioned here is defined as the value obtained by molding the toner under a pressure of 100 kg/cm$^2$, applying an electrical field of 100 V/cm thereon and calculating from the current value after lapse of 1 minute after application.

In preparing the toner according to the present invention, there can be applied the method in which constituent materials are well kneaded by a hot kneading machine such as hot rolls, kneader, extruder and then mechanically crushed and classified; the method in which materials are dispersed in a binder resin solution and then spray dried; the toner preparation method according to the polymerization method in which predetermined materials are mixed in a monomer which should constitute the binder resin to form a suspension, followed by polymerization to obtain a toner.

The positively chargeable toner particles according to the present invention are obtained by mixing thoroughly (shaking about 50 times vertically with hands) 10 g of the toner particles left to stand overnight under an environment of 25° C. and 50 to 60% RH and 90 g of a carrier iron powder not coated with a resin having principal particle sizes at 200 to 300 mesh (e.g. EFV 200/300 produced by Nippon Teppun Co.) in an aluminum pot having a volume of about 200 cc under the above environment, and the triboelectric charges of the toner particles are measured according to the conventional blow-off method by use of an aluminum cell having a 400 mesh screen. The toner particles with positive triboelectric charges measured according to this method are made the positively chargeable toner particles.

The positively chargeable toner particles of the present invention should desirably have triboelectric charges of +9 μc/g to +20 μc/g, preferably +9 μc/g to +15 μc/g.

The toner particles should preferably have a volume average particle size of 5 to 30 μm, preferably 7 to 15 μm.

As the device for measuring the particle size of the toner, Coulter counter TA-II model (produced by Coulter Co.) is used, which is connected to an interface outputting the number average distribution and the volume average distribution (produced by Nikkaki) and CX-1 personal computer (produced by Canon), and a 1% aqueous NaCl solution is prepared by use of the first grade sodium chloride as the electrolyte. As the measuring method, 0.1 to 5 ml of a surfactant (preferably an alkylbenzenesulfonic acid salt) is added as the dispersing agent into 100 to 150 ml of the above aqueous electrolyte, and further 0.5 to 50 mg of a sample to be measured is added. The electrolyte having the sample suspended therein is subjected to the dispersing treatment by a sonication dispersing instrument for about 1 to 3 minutes, and the particle size distribution of the particles of 2 to 40μ is measured by the above Coulter counter TAII model by use of 100μ aperture as the aperture to determine volume average distribution and number average distribution.

In the present invention, the positively chargeable magnetic toner, the negatively chargeable resin fine particles and the positively chargeable silica fine particles are essential components, and in addition to satisfying the physical properties as described above, by satisfying mutually the following relationships shown below, a positively chargeable one component magnetic developer having good developing characteristics, environmental resistance and durability can be provided.

(i) amount of positively chargeable silica fine particles added > amount of negatively chargeable resin fine particles added, (ii) average primary particle size of positively chargeable silica fine particles > average primary particle size of negatively chargeable resin fine particles (iii) |triboelectric charges of positively chargeable silica fine particles| > 5 × |triboelectric charges of negatively chargeable resin fine particles|

(iv) |triboelectric charges of positively chargeable silica fine particles| > 15 × |triboelectric charges of positively chargeable magnetic toner|, and (v) |triboelectric charges of positively chargeable magnetic toner| > |triboelectric charges of negatively chargeable resin fine particles|

The present invention is described below in more detail by referring to Examples and Comparative Examples, but the present invention is not limited to these. All the parts in the respective Examples are by weight.

EXAMPLE 1

| | |
|---|---|
| Styrene-2-ethylhexylacrylate copolymer | 80 parts by weight |
| Styrene-butadiene copolymer | 20 parts by weight |
| Silicon containing magnetic material (average particle size: 0.3 μm) (silicon element exists with gradually increasing content from the surface of the magnetic material to the central portion, with the existing ratio of silicon element being 0.7% by weight based on iron element) | 70 parts by weight |
| Low molecular weight polyethylene | 3 parts by weight |
| Positively chargeable controlling agent (Nigrosine) | 2 parts by weight |

The above components were mixed, and melted and kneaded on roll mills. After cooling, the mixture was pulverized coarsely by a hammer mill and then finely pulverized by means of a jet pulverizer. Next, the powder was classified by use of a wind force classifying machine to obtain black powder (toner particles) with a volume average particle size of 12 μm. Said black powder was found to have triboelectric charges of +10 μc/g and a volume resistivity value of $10^{13}$ Ω.cm.

100 parts by weight of silica fine particles synthesized according to the dry process (trade name: Aerosil #130, specific surface area of about 130 $m^2/g$, produced by Aerosil Co.) were maintained at about 250° C. under stirring and treated by spraying of 20 parts by weight of a silicone oil having amino groups in the side chain (viscosity at 25° C. of 70 cps, amine equivalent: 830) for 10 minutes. The treated silica obtained had an average particle size of about 20 mμ, triboelectric charges of +200 μc/g and a hydrophobicity of 60.

To 100 parts by weight of the toner comprising the above black fine powder were added and mixed 0.4 part by weight of the silica fine particles treated with a silicone oil having amino groups in the side chain as described above and 0.2 part by weight of the polyvinylidene fluoride fine particles obtained by the emulsion polymerization method (spherical fine particles with crystallinity of 78%, primary average particle size of 0.2μ, triboelectric charges of −27 μc/g) to prepare a positively chargeable one component magnetic developer.

A high gradation digital copying machine {the printer portion was NP-9030 (equipped with A-Si drum; the reversal developing system with a developing contrast of +280 V)} was used.

The reader portion of the test copying machine, in order to obtain gradation of half tone when forming images by converting digital image signals into binary values, had the digital image signals once converted into analog signals, which analog signals were compared with periodical pattern signals such as triangular waves, whereby binary signals applied with pulse width modulation were generated and the binary signals were utilized as the driving signals for laser beam source to obtain both high resolution and high gradation of 256 stages.

The above developer was thrown into the above high gradation digital copying machine for testing, and image formation was effected by reversal development of positively charged electrostatic latent images. As the result, sharp images without fog could be obtained, and the image reflection density was 1.30. Further, when successive copying of 40,000 sheets was conducted for examination of the durability of the developer, sharp images without fog similar to those at the initial stage could be obtained (image density: 1.32). On the other hand, when image formation was effected similarly under the environment of high temperature and high humidity (30° C., 90% RH), good images with image density of 1.25 and without problems such as fog could be obtained. Even under the environment of low temperature and low humidity (10° C., 10%), sharp images without fog could be obtained.

EXAMPLE 2

100 parts by weight of a styrene-butyl methacrylate (weight ratio: 7:3) copolymer, 65 parts by weight of magnetite containing 0.5% by weight of silicon element (average particle size: 0.2 μm), 2 parts by weight of Nigrosine and 3 parts by weight of polyethylene wax were mixed, and melted and kneaded on roll mills. After cooling, the mixture was pulverized coarsely and then finely pulverized by means of a jet pulverizer. Subsequently, the powder was classified by use of a wind force classifying machine to obtain black fine powder (toner) with a particle size of 12 μm. Said toner had triboelectric charges of +12 μc/g and a volume resistivity value of $10^{13}$ Ω.cm.

100 parts by weight of silica fine particles (Aerosil #200, produced by Nippon Aerosil Co.) were charged into a closed type Henschel mixer heated to 70° C., and stirred at a high speed while adding dropwise γ-aminopropyltriethoxy silane diluted with alcohol so that the treated amount of the silane coupling agent was 10.0% by weight based on the silica. After the fine particles obtained were dried at 120° C., the particles were again charged into a Henschel mixer, and hexamethyldisilazane was sprayed to 10 parts by weight based on said silica under stirring. The mixture was stirred at a high speed at room temperature for 2 hours, further at 80° C. for 24 hours, and then the mixer was opened to atmospheric pressure. The mixture was further dried under atmospheric pressure at 60° C. for 5 hours under stirring. The silica obtained had an average particle size of 15 mμ, a hydrophobicity of 40 and triboelectric charges of +220 μc/g.

Said treated silica fine powder (0.6 part by weight) and 0.5 part by weight of a polyvinylidene fluoride fine particles (crystallinity: 70%, primary particle size: 0.4 μm, triboelectric charges: −22 μc/g) were added to and mixed with 100 parts by weight of the above toner to prepare a positively chargeable one component magnetic developer.

Subsequently, by use of a high speed copying machine of a process speed of 340 mm/sec (corresponding to about 70 sheets of A4 papers/min), a negative electrostatic image was formed on an OPC photosensitive material, and an image was formed by use of the above developer and transferred onto a plain paper, followed by fixing by heating. The transferred image obtained had a sufficiently high density of 1.35, and also without fog to give a good image of high resolving power without scattering of the toner around the image. Transferred images were prepared continuously by use of the above developer for examination of durability, and also the transferred image after copying of 40,000 sheets was found to be an image comparable with the image at the initial stage.

On the other hand, when image formation was effected in the same manner under an environment of high temperature and high humidity (30° C., 90% RH), an image with an image density of 1.30 without any problem such as fog, etc. could be obtained. Also under an environment of low temperature and low humidity (10° C., 10%), a sharp image without fog could be obtained.

COMPARATIVE EXAMPLE 1

A developer was obtained in the same manner as in Example 1 except for adding no fine particle of polyvinylidene fluoride (PVDF), and image formation was effected by throwing the developer into a high gradation digital copying machine for testing. At initiation, a sharp image without fog similar to Example 1 was obtained and the image reflection density was 1.30. However, after successive copying of 10,000 sheets, the image density was lowered to 0.90.

COMPARATIVE EXAMPLE 2

When image formation was effected in the same manner as in Example 2 except for using negatively chargeable silica fine powder Aerosil 200 in place of the positively chargeable silica, the transferred image obtained had a low density of 0.80, which was a poor image with partial reversal development phenomenon.

In the following, preparation examples of magnetic powder containing silicon element are shown.

PREPARATION EXAMPLE 1

Into a system comprising a mixture of 100 parts by volume of an aqueous 0.8M $FeSO_4$ solution, 100 parts by volume of an aqueous 0.02M sodium silicate solution and 100 parts by volume of an aqueous 0.85M caustic soda solution, steam and oxygen were blown to effect oxidation at about 70° C. The black powder obtained was filtered, washed with water and dried at 50° C. to obtain magnetic iron oxide powder containing 0.4% by weight of silicon element.

The magnetic iron oxide had an apparent bulk density of 0.25 g/cc, toluene dispersibility of 7 mm in terms of the sedimentation length after 1 hour, an average particle size of 0.28 μm and a BET specific surface area of 7.9 $m^2/g$.

PREPARATION EXAMPLE 2

When Preparation Example 1 was repeated except for using an aqueous 0.06M sodium silicate solution in place of the above aqueous 0.02M sodium silicate solution, magnetic iron oxide powder containing 1.0% by weight of silicon element was obtained.

The magnetic iron oxide had an apparent bulk density of 0.27 g/cc, toluene dispersibility of 5 mm in terms of the sedimentation length after 1 hour, an average particle size of 0.26 μm and a BET specific surface area of 8.2 $m^2/g$.

EXAMPLE 3

| | |
|---|---|
| Styrene/butyl methacrylate copolymer (copolymerized weight ratio: 80/20, weight average molecular weight Mw: about 300,000) | 100 parts by weight |
| Magnetic powder of Preparation Example 1 | 70 parts by weight |
| Low molecular weight polyethylene wax | 4 parts by weight |
| Nigrosine (number average particle size: about 4 μm) | 5 parts by weight |

After the above materials were well blended by a blender, the blend was kneaded on two rolls heated to 150° C. The kneaded product obtained was left to cool naturally, coarsely pulverized by a cutter mill, then pulverized by means of a fine pulverizer with jet air stream, further classified by use of a wind force classifier to obtain black fine powder (toner particles) with a volume average particle size of 12 μm (number average particle size: about 10 μm; triboelectric charges: +12 μc/g; volume resistivity value: $10^{13}$ Ω.cm).

To 100 parts by weight of the black powder, 0.5 part by weight of a positively chargeable hydrophobic dry process colloidal silica (primary average particle size: about 10 mμ, triboelectric charges: +150 μc/g, hydrophobicity: 55) and 0.15 part by weight of polyvinylidene fluoride fine particles (primary average particle size: 0.2μ, triboelectric charges: −33 μc/g, crystallinity: 60) were added and mixed in a Henschel mixer to form a positively chargeable one component magnetic developer.

By use of the high gradation digital copying machine described in Example 1 (64 gradation), a positively charged electrostatic latent image was visualized by reversal development to obtain a toner image. Even in durability test of 10,000 sheets or more, good toner images with image density of 1.2 or higher substantially without fog could be obtained.

EXAMPLE 4

A positively chargeable one component magnetic developer was obtained and evaluated in the same manner as in Example 3 except for using the magnetic powder of Preparation Example 2 in place of the magnetic powder of Preparation Example 1 used in Example 3.

As the results, both the charging amount and the image density were stable. There was also no problem even after repeated copying.

EXAMPLE 5

| | |
|---|---|
| Styrene/butyl methacrylate (copolymerized weight ratio: 70/30) | 100 parts by weight |
| Magnetic powder of Preparation Example 1 | 75 parts by weight |
| Nigrosine | 3 parts by weight |
| Low molecular weight polyethylene wax | 4 parts by weight |

By use of the above materials, a positively chargeable magnetic toner (volume average particle size: 11μ; triboelectric charges: +20 μc/g; volume resistivity value: $10^{13}$ Ω.cm) was obtained in the same manner as in Example 3, and a positively chargeable one component magnetic developer was prepared and evaluated in the same manner as in Example 3.

As the result, both the charging amount and the image density were stable. There was also no problem after repeated copying.

EXAMPLE 6

A positively chargeable one component magnetic developer was obtained and evaluated in the same manner as in Example 1 except for using dibutyl tin borate (number average particle size: about 4 μm) in place of Nigrosine, and using as the hydrophobic colloidal silica the positively chargeable silica fine powder (primary average particle size: 25 mμ, triboelectric charges: +190 μc/g, hydrophobicity: 60) treated with a silicone oil having the following partial constituent units:

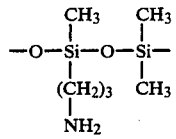

(nitrogen amount equivalent: 830, viscosity at 25° C.: 80 cps). The positively chargeable magnetic toner had a volume average particle size of 8.0μ, triboelectric charges of +13 μc/g and a volume resistivity value of $10^{13}$ Ω.cm.

The developer exhibited stable charging amount, and a good image density of 1.30 was obtained. The development contrast in reversal developing refers to the absolute value of the average light portion potential of the photosensitive drum (potential value occupying the main region in the light portion region) from which the developing potential is detracted.

We claim:

1. A positively chargeable, one component type magnetic developer, comprising:

100 parts by weight of a positively chargeable magnetic toner having triboelectric charges of +9 μc/g to +20 μc/g and a volume average particle size of 5 to 30 μm, 0.01 to 5 parts by weight of negatively chargeable resin fine particles having triboelectric charges of $-10$ μc/g to $-40$ μc/g and a primary average particle size of 0.01 to 4 μm, and 0.05 to 10 parts by weight of positively chargeable silica fine particles having triboelectric charges of $+100$ to $+300$ μc/g and a primary average particle size of 5 mμ two 30 mμ, wherein the amount of positively chargeable silica fine particles is greater than the amount of negatively chargeable resin fine particles, the positively chargeable magnetic toner, the negatively chargeable resin fine particles, and the positively chargeable silica fine particles satisfying the following relationships:

(a) |triboelectric charges of the positively chargeable silica fine particles $|>5\times|$ triboelectric charges of the negatively chargeable resin fine particles|

(b) triboelectric charges of the positively chargeable silica fine particles $|>15\times|$ triboelectric charges of the positively chargeable magnetic toner|, and (c) |triboelectric charges of the positively chargeable magnetic toner $|>|$ triboelectric charges of the negatively chargeable resin fine particles|.

2. A developer according to claim 1, wherein the negatively chargeable resin fine particles comprise fluorine-containing vinyl resin fine particles, and the positively chargeable silica fine particles comprise hydrophobic silica having a hydrophobicity of 30 to 80 according to the methanol titration test.

3. A developer according to claim 1, wherein the negatively chargeable resin fine particles have greater average primary particle sizes than the average primary particle size of the positively chargeable silica fine particles.

4. A developer according to claim 1, wherein the positively chargeable silica fine particles have an absolute value of triboelectric charges which is 5-fold or more of the absolute value of the triboelectric charges of the negatively chargeable resin fine particles.

5. A developer according to claim 1, wherein the positively chargeable silica fine particles have an absolute value of triboelectric charges which is 15-fold or more of the absolute value of the triboelectric charges of the positively chargeable magnetic toner.

6. A developer according to claim 1, wherein the negatively chargeable resin fine particles have an absolute value of triboelectric charges greater than the absolute value of the triboelectric charges of the positively chargeable magnetic toner.

7. A developer according to claim 1, wherein the positively chargeable magnetic toner, the negatively chargeable resin fine particles and the positively chargeable silica fine particles satisfy the following relationships:

(i) amount of positively chargeable silica fine particles added $>$ amount of negatively chargeable resin fine particles added, (ii) average primary particle size of positively chargeable silica fine particles $<$ average primary particle size of negatively chargeable resin fine particles.

8. A developer according to claim 7, wherein the positively chargeable magnetic toner has a volume resistivity value of $10^{10}$ Ω.cm. or more.

9. A developer according to claim 8, wherein the positively chargeable magnetic toner has a volume resistivity value of $10^{12}$ Ω.cm. or more.

10. A developer according to claim 7, wherein the negatively chargeable resin fine particles comprise fluorine-containing vinyl resin fine particles having a crystallinity of 60% or higher.

* * * * *

UNITED STATES PATENT AND TRADEMARK OFFICE

CERTIFICATE OF CORRECTION

PATENT NO. 4,980,256

DATED December 25, 1990

INVENTOR(S) SEIICHI KATO, ET AL.

It is certified that error appears in the above-identified patent and that said Letters Patent is hereby corrected as shown below:

COLUMN 9

Table, "Co." should read --Co.)--.

COLUMN 12

Line 26, "particles >" should read --particles <--.
Line 35, "toner |>|" should read --toner |<|--.

COLUMN 17

Line 8, "two" should read --to--.
Line 26, "|>|" should read --|<|--.

Signed and Sealed this

Eighth Day of September, 1992

*Attest:*

DOUGLAS B. COMER

*Attesting Officer*

*Acting Commissioner of Patents and Trademarks*